US010451392B2

(12) United States Patent
Muster et al.

(10) Patent No.: US 10,451,392 B2
(45) Date of Patent: Oct. 22, 2019

(54) TRACER AMMUNITION

(71) Applicant: RUAG Ammotec AG, Thun (CH)

(72) Inventors: Michael Muster, Urtenen-Schoenbuehl (CH); Donald Meyer, Grolley (CH); Peter Spatz, Schmitten (CH)

(73) Assignee: RUAG Ammotec AG, Thun (CH)

( * ) Notice: Subject to any disclaimer, the term of this patent is extended or adjusted under 35 U.S.C. 154(b) by 0 days.

(21) Appl. No.: 15/548,136

(22) PCT Filed: Feb. 10, 2016

(86) PCT No.: PCT/CH2016/000028
§ 371 (c)(1),
(2) Date: Aug. 2, 2017

(87) PCT Pub. No.: WO2016/131158
PCT Pub. Date: Aug. 25, 2016

(65) Prior Publication Data

US 2018/0023932 A1 Jan. 25, 2018

(30) Foreign Application Priority Data

Feb. 18, 2015 (EP) ..... 15405012

(51) Int. Cl.
*F42B 12/38* (2006.01)
*C06C 15/00* (2006.01)

(52) U.S. Cl.
CPC ..... *F42B 12/38* (2013.01); *C06C 15/00* (2013.01)

(58) Field of Classification Search
CPC ..... F42B 12/36; F42B 12/38; C06B 27/00; C06C 15/00
(Continued)

(56) References Cited

U.S. PATENT DOCUMENTS 581,946 A * 5/1897 Semple ..... F42B 12/38 102/205
1,301,380 A 4/1919 Buckingham
(Continued)

FOREIGN PATENT DOCUMENTS

CH 45 152 A 10/1909
DE 19 66 993 A1 4/1976
(Continued)

OTHER PUBLICATIONS

International Search Report of PCT/CH2016/000028, dated May 30, 2017.
(Continued)

*Primary Examiner* — James S Bergin
(74) *Attorney, Agent, or Firm* — Collard & Roe, P.C.

(57) ABSTRACT

Tracer ammunition for tracking the trajectory and/or the impact of projectiles in the target generally contains pyrotechnics. These pyrotechnics demonstrate various disadvantages, wherein the most serious is the continued burning of the pyrotechnics, even after penetration of the projectile in the target. This causes an increased risk of fire and acute injuries. A mixture of light metal and a carbon-containing substrate, ignites during firing of a projectile and burns during its flight by means of air oxygen introduced into the combustion chamber by way of tear-off edges, and produces a tracer that extinguishes in the target.

16 Claims, 2 Drawing Sheets

Figure 1:
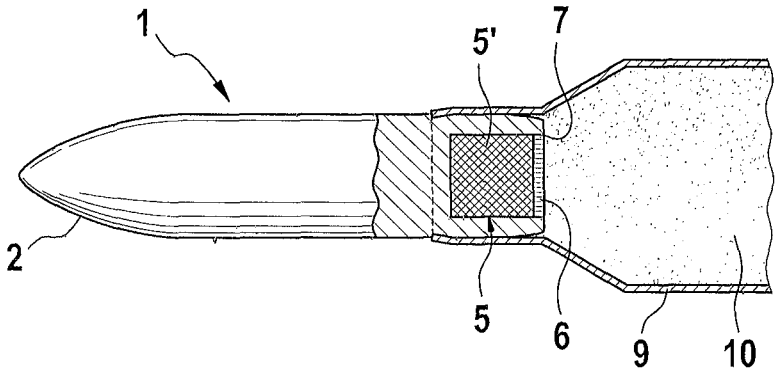

(58) Field of Classification Search
USPC ..... 102/439
See application file for complete search history.

(56) References Cited

U.S. PATENT DOCUMENTS

| | | | | |
|---|---|---|---|---|
| 3,088,857 | A | 5/1963 | Matusewicz | |
| 3,726,495 | A * | 4/1973 | Gawlick | F42B 10/34 102/503 |
| 3,983,818 | A * | 10/1976 | Ciccone | F42B 12/38 102/364 |
| 4,094,711 | A | 6/1978 | Ramnarace | |
| 4,130,061 | A * | 12/1978 | Boggs | C06B 27/00 102/501 |
| 4,142,466 | A * | 3/1979 | Ballreich | F42B 12/38 102/513 |
| 4,301,732 | A * | 11/1981 | Van Sickle | F42B 12/38 102/430 |
| 4,528,911 | A * | 7/1985 | DePhillipo | F42B 12/38 102/513 |
| 4,597,810 | A | 7/1986 | Trickel et al. | |
| 5,760,329 | A * | 6/1998 | Baum | F42B 12/34 102/439 |
| 6,497,181 | B1 | 12/2002 | Manole et al. | |
| 8,007,608 | B1 | 8/2011 | Herbage et al. | |
| 8,402,896 | B1 | 3/2013 | Hollerman et al. | |
| 9,739,584 | B2 * | 8/2017 | Chua | F42B 12/382 |
| 2004/0099173 | A1 | 5/2004 | Rector et al. | |
| 2007/0017409 | A1 * | 1/2007 | Mansfield | F42B 12/06 102/518 |

FOREIGN PATENT DOCUMENTS

| | | |
|---|---|---|
| DE | 102 32 441 A1 | 2/2004 |
| EP | 1 090 895 A1 | 4/2001 |

OTHER PUBLICATIONS

United States Statutory Invention Registration H489, Brodman et al., Chemical Agent Detecting Projectile, Jul. 5, 1998.

* cited by examiner ( A - A )

( B - B )

TRACER AMMUNITION

CROSS REFERENCE TO RELATED APPLICATIONS

This application is the National Stage of PCT/CH2016/000028 filed on Feb. 10, 2016, which claims priority under 35 U.S.C. § 119 of European Application No. 15405012.4 filed on Feb. 18, 2015, the disclosure of which is incorporated by reference. The international application under POT article 21(2) was not published in English.

The present invention relates to tracer ammunition.

Tracer ammunition is often used in military exercises and operations in order to allow hit optimization for the shooter and/or the operations management. Generally, pyrotechnic combustible sets are used as tracers; most of these are toxic.

Tracer ammunition of the stated type, based on magnesium and strontium peroxide, is known from the U.S. Pat. No. 4,597,810.

Pyrotechnic mixtures are disadvantageous for numerous reasons: Their use often causes wildfires and/or severe injuries (burns); heavy metal additives in pyrotechnics furthermore cause lasting environmental damage; during transport, they are classified as hazardous goods and require special transport means; they are relatively complicated and costly in terms of their production; acquisition of the raw materials is cost-intensive. The significant change in the external ballistics of this type of projectiles as the result of burn-off of the pyrotechnic sets and the related changes in the center of gravity are particularly disadvantageous. As a result, the actual task of tracer ammunition is not fulfilled, namely an increase in the hit accuracy of the ordnance ammunition by means of supplementing it with tracer ammunition is lost, to a great extent.

Accordingly, numerous alternatives were used, with greater or lesser success, such as chemiluminescence (U.S. Pat. No. 6,497,181), battery-operated LEDs, light-emitting diodes (US-A1-2004/0099173), and HLA—hybrid luminescence from photoluminescence and/or triboluminescence materials (U.S. Pat. No. 8,402,896).

Infrared tracer ammunition is known from U.S. Pat. No. 8,007,608, which contains a pellet composed of a "tracer ignition composition," which contains boron and potassium perchlorate as an oxygen carrier and a luminous "tracer composition." The latter consists predominantly of magnesium and carbon-containing polymers, and serves as a combustible. Ammunition with oxygen carriers has the disadvantage mentioned initially, that this ammunition also continues to burn in the target until the integrated oxygen carrier has been used up, and this can lead to very severe injuries and is furthermore a general fire hazard.

Furthermore, a projectile having an axial bore is known from US H 489, which projectile serves for a simple spectral analysis, in that oxygen is supplied to a generously dimensioned pyrotechnic mixture through the longitudinal bore, into the rear region, and produces a correspondingly large flame there. This is supposed to make the presence of chlorine compounds, mustard gas, phosgene, tear gas, etc. detectable by means of color changes. This projectile also continues to burn when it hits the ground and/or an object.

It is the task of the invention to create tracer ammunition that guarantees reliable trajectory tracking (tracing) and nevertheless is less of a fire hazard. In particular, it is supposed to extinguish in the target when it hits, and is not supposed to cause any environmental damage caused by toxic components. The external ballistics of a projectile equipped with a "tracer" are not supposed to differ from a usual standard projectile, or only differ slightly. In this regard, no oxygen carriers or pyrotechnic mixtures are supposed to be used.

This is accomplished by means of the characteristics according to the invention. Surprisingly, a mixture of light metal or a light-metal alloy and at least one carbon-containing substrate ignites when a projectile according to the invention, filled into a cartridge, is fired. The oxygen required for combustion is supplied to the combustible mixture solely by means of a suitable design of the projectile, during its flight.

There is no oxygen-carrier contained in the combustible mixture inside the projectile. In particular, the oxygen needed to burn up the mixture of light metal or light metal alloy (in any sort of solid form), with at least one carbon containing substrate, enters the projectile with the outside air, due to the projectile's special layout.

Advantageous further developments of the object of the invention are discussed below.

Combustible mixtures according to an embodiment, on the basis of magnesium and titanium, were tested experimentally.

The carbon-containing substrate according to an embodiment increases the burning duration of the light-metal alloy and thereby allows pursuit of the trace of a projectile over its entire range of use.

The tear-off edge according to an embodiment leads to intensive eddy formation in the combustible region of the projectile and thereby supplies the combustion chamber with air oxygen.

Suitable embodiments configure the combustion chamber as a dead-end bore having a diameter of 2.0 to 9.0 mm and a length of 2.0 to 11.0, wherein the combustible mixture and the center of gravity of the projectile must be taken into consideration when selecting the dimensions.

The tracer ammunition according to an embodiment is aerodynamically advantageous, but relatively expensive in terms of its production.

The diffuser according to an embodiment acts as such in the supersonic range and allows an increase in the diameter of the central longitudinal bore, which increase is desirable for reasons of production technology.

A sleeve-shaped configuration of the combustible is advantageous, because in this way, its burn-off can be controlled within certain limits; this is particularly true if the combustible is concentrically layered in sandwich-like manner.

The dimensions according to an embodiment in which the longitudinal bore has a diameter of 0.7 mm to 3.0 mm, the turbulence bore has a diameter of 2.0 mm to 6.0 mm, and the combustion chamber has a diameter of 6.0 mm to 11.0 mm are coordinated with small-caliber ammunition.

Transverse bores according to further embodiments are suitable for projectiles that fly relatively slowly—up to about Mach 1.1.

Transverse bores that are offset from one another in pairs, by a few millimeters, increase the reliability of burn-off of the combustible mixture, because they compensate the effects of Taylor vortex flow.

The use of transverse bores is particularly advantageous in the case of medium-caliber ammunition.

In the following, exemplary embodiments of the invention will be explained using drawings.

Figure 2:
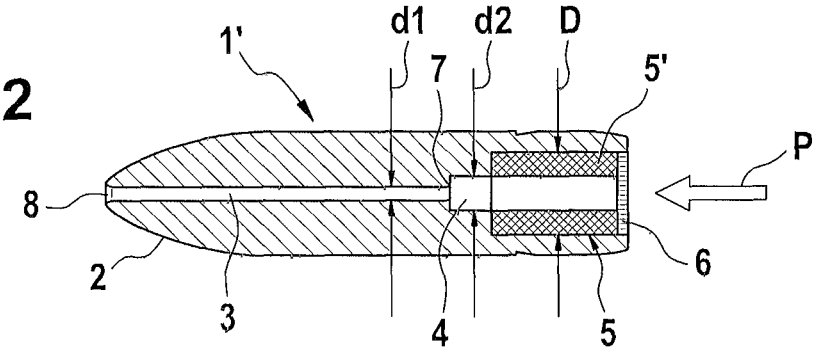
Figure 2A:
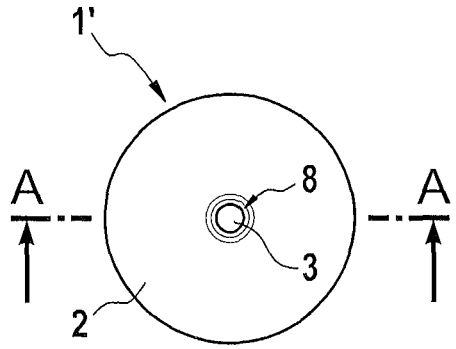
Figure 2B:
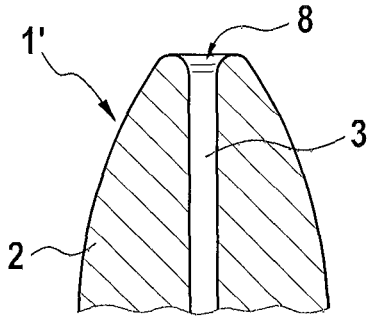
Figure 3:
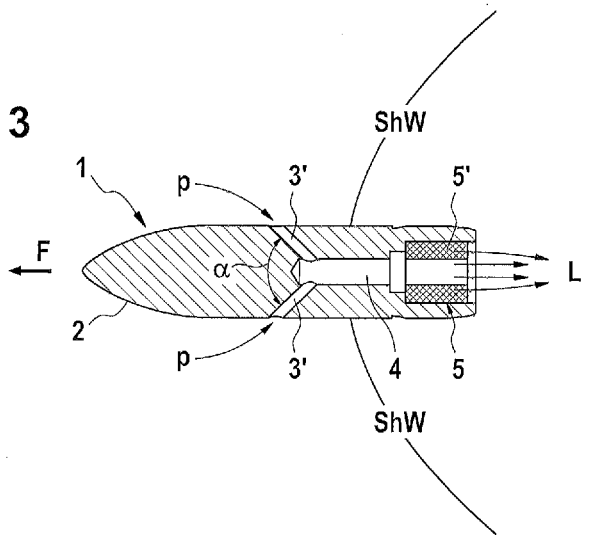
Figure 4:
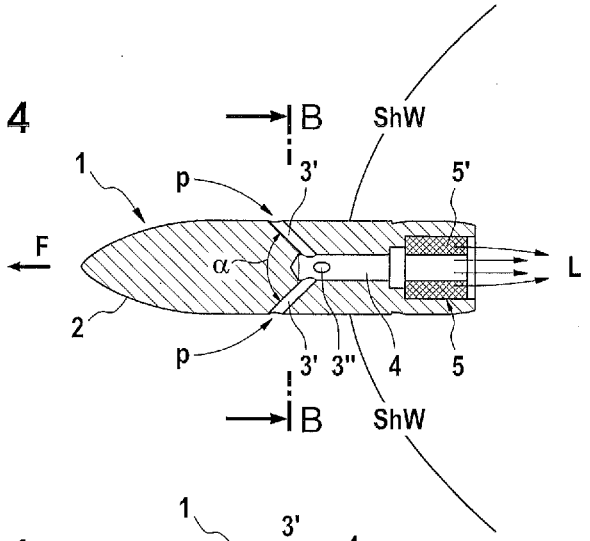
Figure 4A:
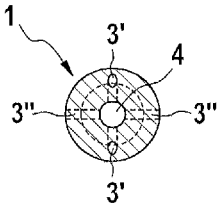

These show:

FIG. 1 a small-caliber projectile according to the invention, having its conventional cartridge and shot charge, in a sectional representation, FIG. 2 a variant of a projectile, represented after it leaves the cartridge, in a sectional representation, FIG. 2*a* a face-side view of the projectile according to FIG. 2, FIG. 2*b* a partial sectional representation of the projectile according to FIG. 2 and FIG. 2*a*, FIG. 3 a further variant of a projectile, during its flight in the range of sonic speed, in a sectional representation, FIG. 4 a further development of the projectile according to FIG. 3, and FIG. 4*a* a representation in a cross-section through the projectile according to FIG. 4.

In FIG. 1, 1 refers to the projectile of a small-caliber tracer ammunition. The front of the projectile is configured as an ogive, as usual, and the projectile is identical, to a great extent, to a well-known ordnance ammunition, to a great extent. On the rear side, a combustion chamber 5 is provided in the projectile 1, in which chamber a combustible 5' is inserted and which chamber is sealed off with a combustible sealing disk 6.

The combustion chamber 5 has a sharp-edged bore that serves as a tear-off edge 7 and generates an eddy formation during flight, which supplies the combustible 5' with air oxygen.

The projectile 1 is placed into a cartridge in usual manner; in a partial section, the cartridge 9 is shown with its shot charge (propellant charge) 10.

This embodiment has the great advantage that as compared with mass-produced ordnance ammunition, only minimal changes at the rear of the projectile are required, by means of installation of a combustion chamber with combustible 5' and sealing disk 6.

Light metals such as magnesium or titanium serve as a combustible; in order to increase the surface area, they are inserted in the form of powder or chips, together with a carbon-containing substrate, such as cotton, graphite fibers or nitrocellulose. The light metal or its alloy can also be processed in the form of powder, foam or films, together with a substrate in the same or a different form, to produce a "combustible pill." In order to achieve a sufficient lighting effect over a shot distance of 300 m, a filling amount of 30 mg magnesium and 30 mg carbon fibers, for example, is sufficient.

The typical pressure P produced when firing the charge (shot charge/propellant charge) in a small-caliber ammunition with caliber 8.5 mm amounts to 350 to 500 MPa. The gas temperature ranges from 2500° C. to 3000° C. The usual firing velocity amounts to 850 m/s to 950 m/s. Spin-stabilized small-caliber ammunition is known to rotate at speeds of rotation up to 250,000 l/min.

It is astonishing that the aforementioned relatively low physical values are sufficient for initiation of the combustible and that the combustible mixture burns during the entire flight of the projectile—without an inherent oxygen carrier—and provides sufficient light for target tracking.

In the subsequent figures, the same parts are provided with the same reference symbols.

In FIG. 2, a projectile 1' having the caliber 8.5 mm, as an alternative to FIG. 1, is shown in the state of firing. The pressure P is shown as a double arrow, wherein here, the projectile 1' has already been pressed out of the cartridge. The high gas temperature present in the rifle barrel, now shown, ignites the sealing disk 6 and thereby also the combustible 5', which is sleeve-shaped here. Oxygen supply to the combustible 5' takes place by way of a front-side supersonic diffuser 8 and a bore 3, which ends in a turbulence bore 4. The bore 3 has a diameter d1 of 1 mm; the turbulence bore possesses a diameter d2 of 3 mm, while the combustion chamber 5 has a diameter D of 5 mm. The diameter jump from d1 to d2 acts as a tear-off edge and brings about the required turbulences for sufficiently supplying the combustible 5' with oxygen.

The interior ventilation of the projectile according to FIG. 2, as described above, is actually known from DE-A1-102 32 441, according to which an axial channel is supposed to lead to an increase in its range and to improved external ballistics.—This hypothesis is unimportant here; the central longitudinal bore 3 serves for supplying oxygen to the combustible mixture according to the invention.

FIGS. 2*a* and 2*b* show the supersonic diffuser 8 and the bore 3, wherein FIG. 2*b* is a partial sectional representation A-A.

In FIG. 3, a medium-caliber projectile 1" that is in flight is shown in a sectional representation. This is a variant of the example according to FIG. 2, where the air oxygen flows into the turbulence bore 4 through bores 3', as the result of the dynamic pressure p. For concentric intensification of the turbulences that are advantageous for burning off the combustible 5' tear-off edges 7 are also provided in FIG. 3 and FIG. 4, analogous to FIG. 2. The angle between the bores 3' that lie opposite one another amounts to $\alpha=160°$. The flight direction is indicated with F; the light beams are indicated with L, wherein in this state, the previously present sealing disk 6 has already burned away.

While the exemplary embodiments according to FIG. 1 and FIG. 2 relate to projectiles having at least 2.5 times the velocity of sound, FIG. 3 and FIG. 4 relate to those that are in the sonic range. Accordingly, a shock wave front ShW is shown here, in each instance, which must lie behind the bores 3' and 3", respectively (FIG. 3 and FIG. 4) in this case, so that the required interior ventilation occurs. From this, it is evident that these exemplary embodiments are only suitable up to about Mach 1.1, and this holds true for medium-caliber projectiles, for example.

The example according to FIG. 4 takes into account the circumstance that in the case of spin-stabilized projectiles, Taylor vortex flows (TVF=Taylor vortex flow) occur, which can lead to problems with the oxygen supply in the case of bores 3' that lie on the same circumference circle line. This hazard can be eliminated by offsetting the bores 3' relative to the bores 3", see FIG. 4, by 1.5 mm. In the sectional representation B-B, FIG. 4*a*, it can be seen that the horizontal transverse bores 3" lie behind the vertical bores 3'.

The exemplary embodiments described above show that numerous design embodiments are possible, which take optimization of the projectile ballistics and, in particular, the change in center of gravity of the projectile, which changes during flight, into account. It has been proven advantageous, in this connection, that the external supply of air oxygen requires only small amounts of combustible and that these amounts can fundamentally be introduced at the location of the center of gravity.

The object of the invention prevents severe burn injuries (wound ballistics!) by extinguishing the flames when oxygen is absent in the target, and this results in significant progress as compared with convention tracer sets.—Unfortunately, it has been found that ammunition with an integrated oxygen carrier, particularly pyrotechnics, continues to burn, even in the human body, until the oxygen is used up, and this leads to very severe injuries.

REFERENCE SYMBOL LIST

1, 1', 1" small-caliber projectile (rifle cartridge 6.5 mm)
2 ogive

3 central longitudinal bore
3' transverse bore
3" transverse bore offset relative to 3'
4 turbulence bore
5 combustion chamber
5' combustible/combustible sleeve
6 sealing disk (gas seal, combustible)
7 tear-off edge (sharp).
8 supersonic diffuser
9 cartridge sleeve
10 shot charge (propellant charge)
α angle between bores 3'
d1 bore of 3
d2 bore of 4'
D outside diameter of 5
F flight direction
L light beams (beam bundle)
p partial dynamic pressure
ShW shock wave front

The invention claimed is:

1. Tracer ammunition comprising
a cartridge having a firing cap,
propellant charge powder, and
a projectile body inserted into the cartridge, wherein the projectile body comprises a rear-side bore in a rear region of the projectile body and a combustible mixture laid into the rear-side bore, and a rear-side, combustible gas seal that ignites when the projectile is fired,
wherein the combustible mixture comprises light metal or a light-metal alloy in the form of powder and/or chips, foam or films, and at least one carbon-containing substrate,
wherein at least one tear-off edge is provided in the projectile, which edge supplies the combustible mixture with air oxygen,
wherein the projectile is configured to travel in a sonic range and generate a shock wave front, and
wherein at least two transverse bores that lie opposite one another are present ahead of the shock wave front, which bores end in a turbulence bore and introduce a partial dynamic pressure into the turbulence bore.

2. Tracer ammunition according to claim 1, wherein the light metal comprises magnesium or titanium or their alloys.

3. Tracer ammunition according to claim 1, wherein the substrate has a lower calorific value as compared with the light metal.

4. Tracer ammunition according to claim 1, wherein in the rear region of the projectile body, a combustion chamber having a concentric tear-off edge is provided.

5. Tracer ammunition according to claim 4, wherein the combustion chamber is configured as a dead-end bore, has a diameter of 2.0 to 9.0 mm and a length of 2.0 to 11.0 mm.

6. Tracer ammunition according to claim 1, wherein a central longitudinal bore opens into a rear-side combustion chamber.

7. Tracer ammunition according to claim 6, wherein a supersonic diffuser is provided on a front side of the longitudinal bore.

8. Tracer ammunition according to claim 7, wherein the longitudinal bore forms a tear-off edge at the transition to the combustion chamber.

9. Tracer ammunition according to claim 8, wherein the combustible mixture is configured in sleeve shape.

10. Tracer ammunition according to claim 7, wherein the longitudinal bore has a diameter of 0.7 to 3.0 mm and ends in a turbulence bore, the turbulence bore has a diameter of 2.0 mm to 6.0 mm, and the combustion chamber has a diameter of 6.0 mm to 11.0 mm.

11. Tracer ammunition according to claim 1, wherein the tracer ammunition is a small-caliber ammunition.

12. Tracer ammunition according to claim 1, wherein the at least two transverse bores are disposed at an angle of 120° to 180°.

13. Tracer ammunition according to claim 1, wherein two of the at least two transverse bores that lie opposite one another, in each instance, are offset from one another by at least 1 mm.

14. Tracer ammunition according to claim 1, wherein the tracer ammunition is a medium-caliber ammunition.

15. Tracer ammunition according to claim 1, wherein the combustible mixture does not contain an oxygen carrier.

16. Tracer ammunition comprising
a cartridge having a firing cap,
propellant charge powder, and
a projectile body inserted into the cartridge, wherein the projectile body comprises a rear-side bore in a rear region of the projectile body and a combustible mixture laid into the rear-side bore, and a rear-side, combustible gas seal that ignites when the projectile is fired,
wherein the combustible mixture comprises light metal or a light-metal alloy in the form of powder and/or chips, foam or films, and at least one carbon-containing substrate,
wherein the combustible mixture does not contain an oxygen carrier,
wherein a central longitudinal bore opens into a rear-side combustion chamber having a rear end opening, and
wherein at least one tear-off edge is provided at the rear end opening of the combustion chamber, which edge generates an eddy current during flight to supply the combustible mixture with air oxygen.

* * * * *